United States Patent [19]

Moore

[11] 4,373,423

[45] Feb. 15, 1983

[54] GAS OPERATED MECHANISM HAVING AUTOMATIC PRESSURE REGULATOR

[76] Inventor: Wildey J. Moore, P.O. Box 4046, New Windsor, N.Y. 12550

[21] Appl. No.: 155,793

[22] Filed: Jun. 2, 1980

[51] Int. Cl.[3] ..... F41D 5/08; F41D 5/10

[52] U.S. Cl. ..... 89/191 A; 89/193

[58] Field of Search ..... 89/191 A, 193

[56] References Cited

U.S. PATENT DOCUMENTS

| | | | |
|---|---|---|---|
| 678,969 | 7/1901 | Mclean | 89/191 A |
| 1,066,487 | 7/1913 | Giletta | 89/191 A |
| 3,273,460 | 9/1966 | Mason | 89/191 A |
| 3,968,727 | 7/1976 | Hyytinen | 89/191 A |
| 3,988,964 | 11/1976 | Moore | 89/191 A |
| 3,990,348 | 11/1976 | Vesamaa | 89/191 A |

*Primary Examiner*—Sal Cangialosi

*Attorney, Agent, or Firm*—McCormick, Paulding & Huber

[57] ABSTRACT

A pistol having barrel and a gas operating mechanism coaxially supported on the barrel for axial movement relative thereto and defining an annular gas chamber surrounding an associated portion of the barrel. The gas operating mechanism includes a piston supported for movement relative to the barrel and a regulator plunger disposed generally within the piston, biased toward the piston, and supported for movement relative to both the barrel and the piston. Gases of explosion enter the gas chamber through gas ports in the barrel to move the piston and thereby operate extracting, ejecting and cocking mechanisms. The plunger moves away from the piston in response to predetermined pressure within the chamber to increase the volume of the chamber and decrease pressure therein. The plunger may move to a position wherein gases of explosion are vented from the gas chamber to atmosphere.

16 Claims, 5 Drawing Figures

GAS OPERATED MECHANISM HAVING AUTOMATIC PRESSURE REGULATOR

BACKGROUND OF THE INVENTION

This invention relates in general to gas operated firearms and deals more particularly with an improved gas operating mechanism for a firearm. More specifically, the invention is concerned with an improved gas operating mechanism of an annular type which is coaxially supported on a portion of a firearm barrel to move axially to the barrel in response to pressure generated by gases of explosion. Such a gas operating mechanism is illustrated and described in my U.S. Pat. No. 3,988,964 for GAS OPERATED FIREARM WITH METERING ADJUSTMENT, issued Nov. 2, 1976, and includes a generally cylindrical piston slidably supported on a firearm barrel and which partially defines an annular gas chamber surrounding an associated portion of the barrel. The gas chamber is further defined by a manually adjustable regulator positionable axially along the barrel to meter the escape of gases of explosion from the bore into the gas chamber. A variety of ammunition of a specific caliber is available for a firearm of the aforedescribed general type. However, differences in bullet weight, powder type and quantity influence the operational characteristics of the firearm. Other variables which effect the stability of ammunition, including weather conditions, also influence operational characteristic of a weapon, but are somewhat less predictable. While a manually regulated gas operating mechanism of the aforedescribed general type may be adjusted to compensate for such variables the possibility of human error is ever present. Failure to adjust the gas regulator or an error in judgment in making an adjustment may adversely affect the firing characteristic of a weapon producing excessive recoil with resulting loss of accuracy. Accordingly, it is the general aim of the present invention to provide a gas operating mechanism for a firearm which includes an automatic pressure regulator which compensates for variations in pressure generated by the gases of exploding in firing a weapon and vents the gases of explosion from the gas operating mechanism when excessive gas pressure develops therein.

SUMMARY OF THE INVENTION

In accordance with the present invention a gas operated firearm which includes an improved gas operating mechanism has an axially elongated barrel including a bore opening through its forward end, means defining an annular gas chamber surrounding an associated portion of the barrel and including a guide member mounted on the barrel, a first reaction member supported for reciprocal axial movement on and relative to the barrel and having a first reaction surface defining a portion of the gas chamber, and gas port defining means communicating with the bore and the gas chamber. The improved gas operating mechanism includes a second reaction member supported for reciprocal axial movement relative to both the barrel and the first reaction member and having a second reaction surface further defining the gas chamber, means for biasing said second reaction member toward the first reaction member and to an inactive position, and means defining a vent for communicating with the chamber and the atmosphere to vent gases of explosion from the chamber. The vent means is normally out of communication with the chamber. The second reaction member is movable in opposition to the biasing means and in an axial direction away from the first reaction member and from its inaction position to another position in response to gas pressure within the chamber. The second reaction member is further movable in said axial direction away from the first reaction member and from its other position to a venting position in response to gas pressure within the chamber. The venting means is in communication with the chamber and the atmosphere only when the second reaction member is in its venting position.

DETAILED DESCRIPTION OF PREFERRED EMBODIMENT

Figures 1, 2, 3, 4, 5:
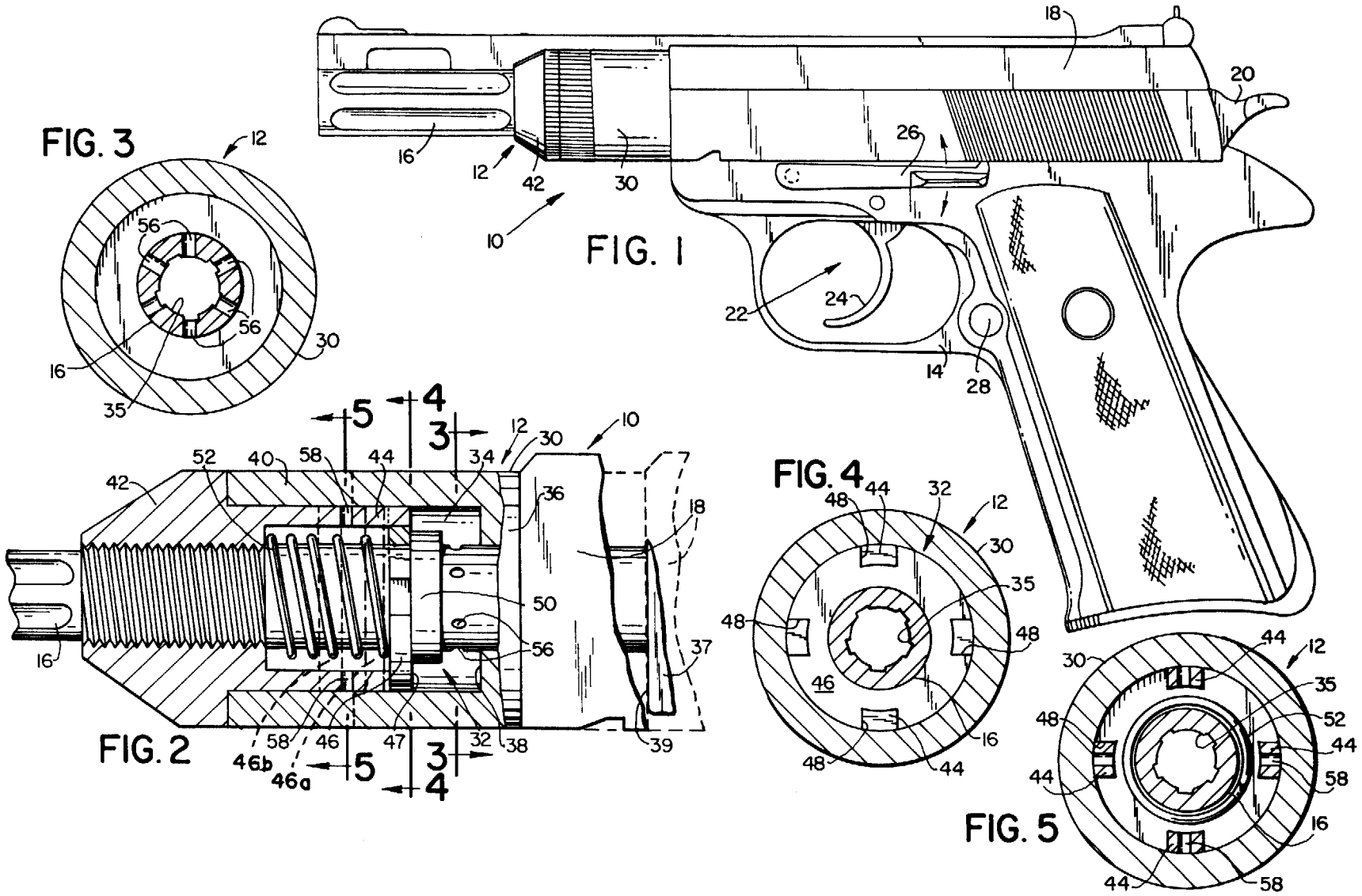
FIG. 1 is a side elevational view of a gas operated pistol embodying the present invention.
FIG. 2 is a somewhat enlarged fragmentary side elevational view of the pistol of FIG. 1 shown partially in longitudinal axial section.
FIG. 3 is a sectional view taken along the line 3—3 of FIG. 2.
FIG. 4 is a sectional view taken along the line 4—4 of FIG. 2.
FIG. 5 is a sectional view taken along the line 5—5 of FIG. 2.

In the drawing and in the further description which follows, a gas operating mechanism embodying the present invention is illustrated and described with reference to a magazine loaded, gas operated pistol indicated generally by the reference numeral 10 in FIG. 1. The pistol 10 is of the type shown in my aforementioned U.S. Pat. No. 3,988,964, which is hereby adopted by reference as a part of the present disclosure. The present gas operating mechanism, indicated generally by the numeral 12, is particularly well adapted to such a firearm, since it requires relatively few parts which are arranged in relatively compact form. However, it should be understood that the invention is not limited to the particular firearm shown and described, but may be used with other firearms of gas operated type or which may be modified for gas operation. The illustrated pistol 10 comprises a frame 14, a barrel 16, a slide 18, a firing mechanism which includes a hammer 20, a trigger mechanism indicated generally at 22 which includes a trigger 24, and a slide stop 26. A box magazine contained with a magazine well formed in the handle part of the frame is retained in the magazine well by a magazine release catch 28.

The slide 18 is shown in forward position from which it is movable rearwardly, either manually or in response to operation to the gas operating mechanism 12, as will be hereinafter more fully described. As the slide moves rearwardly during the firing of a cartridge the bolt (not shown) unlocks and moves rearwardly cocking the hammer 20 and extracting a spent cartridge shell. When the slide 18 is in its forward position and the hammer is in its down position, shown in FIG. 1, the hammer may be moved to a cocked position by thumb-pressure applied to its spur for subsequent firing in a single action manner. The illustrated pistol 10 can also be fired, in a double action manner, by simply squeezing the trigger 24 when the hammer 20 is in its down position.

In accordance with the present invention, the gas operating mechanism 12 includes a first reaction member or piston 30 moved by gases of explosion generated during the firing of a cartridge to move the slide 18 and thereby operate a bolt assembly (not shown) which includes a firing pin and an extractor. The gas operating mechanism automatically compensates for differences in bullet weight, powder charge, and other variables which influence the operational characteristics of the firearm and includes a pressure regulator or plunger assembly indicated generally at 32. The plunger assembly cooperates with the piston 30 to define an annular gas chamber 34 which surrounds an associated portion of the pistol barrel 16. The plunger assembly 32 moves relative to the piston 30 to increase the volume of the gas chamber and thereby reduce gas pressure within the gas chamber when the pressure in the chamber exceeds a predetermined limit. If necessary, the plunger assembly 32 may move to a position wherein the gases of explosion trapped within the gas chamber 34 are vented to atmosphere, all of which will be hereinafter more fully discussed.

Considering now the pistol 10 in further detail and particularly the construction and arrangement of the gas operating mechanism 12, the barrel 16 is generally cylindrical, has a conventional rifled bore 35, and is attached to and extends forwardly from a receiver, indicated at 37 in FIG. 2, which supports the slide 18 for forward and rearward reciprocal movement relative to the pistol frame 14. The receiver defines a forwardly facing stop or abutment surface 39. Further referring to FIG. 2, the piston 30 is supported for limited axial sliding movement on the barrel 16 and has a head portion 36 which is disposed adjacent the forward end of the slide 18 when the slide is in its forward position, as it appears in FIG. 1 and in full lines in FIG. 2. A radially disposed and axially forwardly facing reaction surface 38 on the head portion 36 defines a portion of the gas chamber 34. The piston 30 further includes a generally cylindrical skirt portion 40 which extends forwardly from the head portion 36 in radially outwardly spaced relation to the barrel 16 and further defines a portion of the gas chamber 34. A guide member or annular collar 42 threaded onto the barrel forwardly of the piston 30 limits forward travel of the piston and has a plurality of angularly spaced and axially rearwardly extending integral fingers 44, 44 which project for some distance to the skirt portion 40. The fingers 44, 44 provide bearing surfaces for stabilizing axial movement of the piston 30 on and relative to the barrel 16.

The plunger assembly 32 comprises a second reaction member or generally cylindrical plunger disc 46 slidably received within the skirt portion 40 substantially as shown in FIG. 2. The plunger disc has a radially disposed and axially rearwardly facing reaction surface 47 and a plurality of annularly spaced and radially outwardly opening notches 48, 48 which receive the fingers 44, 44 therein as best shown in FIGS. 4 and 5. An annular flange 50 which is or may be integrally formed on the barrel 16 limits rearward travel of the plunger disc 46, as best shown in FIG. 2. A spring 52 which comprises a part of the plunger assembly surrounds the barrel inwardly of the fingers 44, 44 and acts between the collar 42 and the plunger disc 46 to bias the plunger disc toward engagement with the annular collar 50.

At least one gas port 56 formed in the barrel 16 provides communication between the bore and the gas chamber 34, but preferably, and as shown, a plurality of equiangularly spaced and radially extending gas ports 56, 56 are provided in the barrel 16, as best shown in FIG. 3. The gas ports 56, 56 communicate with the gas chamber 34 rearwardly of the annular collar 50, as shown in FIG. 2.

At least one vent port 58 extends through an associated one of the fingers 44, 44, but preferably and as best shown in FIG. 5 each finger 44 is provided with an associated vent port 58 which communicates with the gas chamber 34 forward of the plunger disc 46 when the latter disc is biased to its position adjacent the annular collar 52. It should be noted that the biasing force exerted upon the plunger disc 46 by the spring 52 is somewhat greater than biasing force exerted upon the slide 18 by its associated spring mechanism and which normally urges the slide to its forward position.

When the pistol 10 is fired, gases of explosion generated by the burning powder propel the projectile down the barrel. As the projectile passes the gas ports 56, 56 gases of explosion escape through the latter ports into the gas chamber 34 and act upon the reaction surface 38 to drive the piston 30 to the rear. The piston has a short stroke or restricted travel, its rearward travel being limited by engagement with the abutment surface 39 on the receiver. However, the rearward movement of the piston imparts sufficient inertia to the slide 18 to cause it to continue to travel toward the rear after the rearward movement of the piston has been arrested, thereby imparting sufficient inertia to the operating mechanism associated with it to carry the mechanism through its firing cycle, whereby to fire, firing, extract, and eject the cartridge from the weapon. When the slide reaches the limit of its rearward travel it is driven forward through the load and lock cycle by a conventional spring biasing mechanism (not shown). During its forward travel the slide 18 engages the piston 30 and drives it back to its initial forward position adjacent the annular collar 42 in preparation for the next shot.

As the piston 30 moves rearwardly in response to gases of explosion gas pressure in the gas chamber 34 also acts upon the rearwardly facing reaction surface 47 to move the regulator plunger disc 46 in an axially forwardly direction. The regulator plunger disc and its associated spring 52 provide a cushioning effect in the gas chamber as the plunger disc 46 moves in an axially forward direction from its inactive or full line position of FIG. 2 to another position such as the position indicated by broken lines at **46*a* to eliminate excessive pressure on the piston as the piston drives the slide mechanism through its firing cycle. If excessive pressure is developed within the gas chamber the plunger disc 56 is driven to a forward or venting position beyond the vent ports 58, 58 the venting position being indicated by broken lines at 46*b*. As the forwardly moving plunger disc 46 moves past the vent ports 58, 58, the forward edge of the rearwardly moving piston skirt 40 also moves to a position rearwardly of the vent ports thereby exposing the vent ports to atmosphere. The gases of explosion trapped within the chamber 34 are then vented to atmosphere through the vent ports 58, 58 thereby preventing the development of excessive pressure within the gas chamber 34. It will now be apparent that the gas operating mechanism 12 automatically compensates for variations in gas pressure resulting from differences in ammunition and other variables which might otherwise alter the operational characteristics of the firearm. It should be noted that gases of explosion are vented from the chamber 34 directly to the atmosphere through the vent ports 58, 58 only if sufficient pressure is developed within the chamber to drive the plunger disc 46 to its venting position indicated at 46***b*.

I claim:

1. In a gas operated firearm having an axially elongated barrel including a bore extending therethrough, means defining an annular gas chamber of variable volume surrounding an associated portion of the barrel and including a guide member mounted on the barrel and a first reaction member coaxially surrounding an associated portion of the barrel and supported for limited axial movement between first and second positions relative to the barrel, and means defining a gas port communicating with the bore and the gas chamber, said first reaction member being movable in one axial direction from its first to its second position in response to gas pressure within the chamber, the improvement comprising a second reaction member supported in coaxial surrounding relation to said barrel by said guide member for axial movement relative to said barrel and said first reaction member, said first and second reaction members having opposing reaction surfaces defining associated portions of said chamber, means for biasing said second reaction member in said one axial direction toward said first reaction member and to an inactive position, and means defining a vent for communicating with said chamber and the atmosphere to vent gases of explosion from said chamber, said vent means being normally out of communication with said chamber, said second reaction member being movable in opposition to said biasing means and in an axial direction opposite said one axial direction from said inactive position to another position in response to gas pressure within said gas chamber, said second reaction member being further movable in said opposite axial direction from said other position to a venting position in response to gas pressure within said chamber, said venting means being in communication with said chamber and with the atmosphere only when said second reaction member is in said venting position.

2. A gas operated firearm as set forth in claim 1 wherein said first and second reaction surfaces comprise generally radially disposed axially opposed surfaces.

3. In a gas operated firearm as set forth in claim 1 wherein said first reaction member comprises a piston having a head portion defining said first reaction surface and an annular skirt portion extending from said head portion and defining another portion of said gas chamber the further improvement wherein said second reaction member comprises a plunger supported in said inactive position within said skirt portion.

4. In a gas operated firearm as set forth in claim 1 the further improvement wherein said guide member comprises means for guiding said first reaction member and said second reaction member to move axially relative to said barrel.

5. In a gas operated firearm as set forth in claim 4 the further improvement wherein said guiding means comprises a plurality of rearwardly extending fingers supported in fixed position relative to the barrel.

6. In a gas operated firearm as set forth in claim 5 wherein said second reaction member has a plurality of openings therein and each of said fingers is received in an associated one of said openings.

7. In a gas operated firearm as set forth in claim 6 wherein said second reaction member comprises a cylindrical member and said openings comprise notches opening radially outwardly through the peripheral surface of said cylindrical member.

8. In a gas operated firearm as set forth in claim 5 the further improvement wherein said guide member comprises an annular collar.

9. In a gas operated firearm as set forth in claim 1 or any one of claims 4 through 7 the further improvement wherein said vent means is defined by said guide member.

10. In a gas operated firearm as set forth in claim 9 the further improvement wherein said vent means is in communication with the atmosphere only when said first reaction member is in its second position.

11. In a gas operated firearm having an axially elongated barrel including a bore extending therethrough, means defining an annular gas chamber of variable volume surrounding an associated portion of the barrel and including a guide member mounted in fixed position on the barrel and a first reaction member coaxially surrounding associated portions of the guide member and the barrel and supported for limited reciprocal axial movement between first and second positions relative to the guide member and the barrel, said first reaction member having a generally radially disposed first reaction surface defining one end portion of the gas chamber, and a gas port in the barrel opening into the bore and the gas chamber, said first reaction member being movable from its first to its second position in response to the pressure of gases of explosion within the chamber, the improvement comprising a second reaction member supported in coaxial surrounding relation to said barrel by said guide member for reciprocal axial movement relative to said guide member, said barrel and said first reaction member, said second reaction member having a generally radially disposed second reaction surface defining another portion of said gas chamber opposite said one end, means for limiting axial movement of said second reaction member in the direction of said first reaction member, means for biasing said second reaction member axially and in the direction of said first biasing member and to an inactive position, and means defining a vent port for communicating with said chamber and the atmosphere to vent gases of explosion from said chamber, said second reaction member being movable in an axial direction away from first reaction member and from said inactive position to another position in response to gas pressure within said chamber, said second reaction member being further movable in said axial direction away from said first reaction member and from said other position to a venting position in response to gas pressure within said chamber, said venting means being in communication with said gas chamber and with the atmosphere only when said second reaction member is in its venting position.

12. In a gas operated firearm as set forth in claim 11 the further improvement wherein said means for limiting movement of said second reaction member comprises a flange on said barrel.

13. In a gas operated firearm having a receiver, an axially elongated barrel projecting axially forwardly from the receiver and having a bore extending coaxially therethrough, a slide member slidably supported on the receiver for movement between forward and rearward positions relative thereto, a guide member mounted in fixed position on the barrel, a piston coaxially supported on the barrel for axial sliding movement relative thereto between first and second position, said piston having a head portion disposed generally adjacent the forward end of the slide member when the piston is in its first position and the slide member is in its forward position, the piston having an annular skirt portion projecting axially forwardly from the head portion in radially spaced relation to the barrel, the piston and the guide member cooperating to define a gas chamber of variable volume surrounding an associated portion of the barrel, and gas port defining means communicating with the bore and with the chamber, the improvement comprising a reaction plunger supported by said guide member within said piston skirt, means for biasing said plunger in an axial direction toward said piston head portion and to an inactive position, said plunger being movable from its inactive position in an axial direction away from said piston head and through a range of positions to a venting position in response to gas pressure within said chamber, and vent means defined by said guide member for venting gases of explosion from said chamber to the atmosphere only when said plunger is in its venting position.

14. In a gas operated firearm as set forth in clam 13 the further improvement wherein said guide member comprises an annular collar mounted on the barrel forward of said piston and having a plurality of angularly spaced rearwardly extending fingers extending into said skirt portion and partially supporting said piston and said reaction plunger for axially sliding movement relative to the barrel.

15. In a gas operated firearm as set forth in claim 14 the further improvement wherein said reaction plunger comprises a generally cylindrical member having a plurality of openings for receiving said fingers.

16. In a gas operated firearm as set forth in claim 15 the further improvement wherein said openings comprise radially outwardly opening notches.

* * * * *